United States Patent [19]

Alley

[11] 4,300,786

[45] Nov. 17, 1981

[54] SNOW SKI WITH ADJUSTABLE CAMBER

[75] Inventor: F. William Alley, Stowe, Vt.

[73] Assignee: Johnson Wax Associates, Racine, Wis.

[21] Appl. No.: 105,056

[22] Filed: Dec. 19, 1979

[51] Int. Cl.[3] ..... A63C 5/07

[52] U.S. Cl. ..... 280/602

[58] Field of Search ..... 280/602, 601, 608, 609, 280/610, 606, 607

[56] References Cited

U.S. PATENT DOCUMENTS 3,300,226 1/1967 Reed, Jr. ..... 280/602

FOREIGN PATENT DOCUMENTS 1467141 12/1966 France ..... 280/602
1526418 4/1968 France ..... 280/602
57634 2/1937 Norway ..... 280/610
210624 10/1940 Switzerland ..... 280/608

*Primary Examiner*—Joseph F. Peters, Jr.
*Assistant Examiner*—Milton L. Smith

[57] ABSTRACT

A snow ski having adjustable camber-flattening resistance and characterized by a flat ski body having opposing side surfaces defining insert-receiving voids extending along the body mid-portion, and elongate body-stiffening inserts removably secured within the voids and providing with the body a particular camber-flattening resistance. A method for providing a ski having a desired camber-flattening resistance characterized by providing a flat ski body with the aforementioned voids defined in the side surfaces thereof, providing an array of inserts having differing stiffness characteristics but each being dimensioned for insertion in the voids, selecting a pair of inserts from the array, and securing such inserts in the voids. Preferred embodiments include inserts which may be used in one of two orientations to provide differing camber-flattening resistances.

6 Claims, 5 Drawing Figures

SNOW SKI WITH ADJUSTABLE CAMBER

BACKGROUND OF THE INVENTION

The present invention relates to snow skis and, more specifically, to skis having adjustable camber-flattening resistance and a method for providing cambered skis having a desired camber-flattening resistance.

The present invention is particularly useful in cross country skis because of the extreme importance of the ski camber, or, more particularly, the camber-flattening resistance of cross country skis to their satisfactory performance. A cross country ski must slide smoothly and freely on the snow in the glide mode, that is, when no driving force is exerted on it by the skier, but must provide significant frictional engagement with the snow during the kick mode, that is, when downward driving force is applied. The ski camber and camber-flattening resistance are important factors in performance.

Such dual functioning is achieved, of course, by the alternate flattening and arching of the ski as it changes from glide mode to kick mode and back again. The most commonly used cross-country skiing technique is the diagonal stride technique. Using this technique, when one ski is in the kick mode, the other is normally in the glide mode, and vice versa. Whatever technique is used, however, in the glide mode the skier's foot is simply resting on the mid-portion of the ski, which has a substantial camber, while in the kick mode the skier exerts a downward, driving force on the ski, which reduces or eliminates the camber.

In the glide mode the ski camber keeps the lower surface of the mid-portion of the ski, that is, the portion generally below the skier's foot, raised above the snow surface or at least prevents loaded contact with the snow. The front and rear portions of the ski, that is, the portions on either side of the mid-portion, bear the weight of the skier in the glide mode.

Such front and rear portions are smooth and are normally waxed to provide good sliding action over the snow. The mid-portion of the lower surface, however, has different surface characteristics, in shape, surface material, and/or a coating (such as "kick wax"), and therefore does not slide as easily over the snow, providing instead a degree of frictional engagement or "bite."

When the ski is in the kick mode, with additional force being applied to the ski mid-portion by the skier's foot, the camber of the ski is flattened to some extent to obtain frictional engagement with the snow. Such frictional engagement allows the skier to thrust his other ski forward in the glide mode. As the skier shuffles along, his left and right skis alternate between the gliding mode and the kick mode.

The camber-flattening resistance of cross country skis is critical to successful operation. If the skis are too rigid, the skier will not be able to engage the mid-portion properly with the snow in the kick mode. On the other hand, if the skis are too flexible, the skier will not glide well in the gliding mode because of the unnecessary friction created between the midportion and the snow.

A number of factors must be considered in choosing an appropriate degree of flexibility. The most obvious of these is the skier's weight. Heavier skiers more easily flatten the ski camber than lighter skiers and usually require a greater camber-flattening resistance in their skis. Another factor is the skier's ability. Highly skilled skiers can exert a great deal more downward driving force than less skilled skiers of the same weight. Thus, highly skilled skiers might prefer a greater camber-flattening resistance in their skis in order to assure good gliding qualities in the gliding mode. Finally, snow conditions are another factor to be considered in choosing a cross country ski. Wet snow tends to allow a better bite than dry snow. Accordingly, a given skier may need skis with a lower camber-flattening resistance for dry snow than he would for wet snow.

In the past, ski manufacturers and sellers have produced a large variety of skis having numerous lengths and flexibilities as a means of providing skis with appropriate camber-flattening resistance for various skiers. While some skiers are able to obtain skis with highly desirable camber-flattening resistance for their weight, skill level, and so forth, many skiers buy skis providing less than optimum performance for them.

Furthermore, over a period of years the skier's weight and his level of ability will change. And, snow conditions obviously change from day to day and hour to hour. A need has existed for a ski which can accommodate widely varying skiers and changing conditions.

BRIEF SUMMARY OF THE INVENTION

The present invention overcomes these problems by providing a unique snow ski with an adjustable camber-flattening resistance and a method for providing customized skis. The ski is characterized by a main ski body having opposing side surfaces defining insert-receiving voids extending along the mid-portion of the ski length, and elongate, body-stiffening inserts removably secured within the voids. The stiffness of the inserts is chosen such that they lend to the ski body a camber-flattening resistance accommodating a particular skier's needs.

The inventive method includes providing a main ski body with voids as described above, providing an array of inserts having differing stiffness characteristics and dimensioned to be removably secured in the voids, selecting a pair of inserts from the array, and securing the selected inserts in the insert-receiving voids.

In certain preferred embodiments the inserts are dimensioned to allow insertion into the voids in either of two rotational orientations rotated 90° apart about the longitudinal axis of the insert. The camber-flattening resistance provided in the first orientation differs from the resistance provided by the second orientation. Such a two-position insert preferably has a square cross-section at points along its length.

Two-position inserts are particularly desirable in adjusting the camber characteristics of the ski to accommodate ski conditions. For example, while a given set of inserts may be most appropriate for a skier of a particular weight range and level of skill, such skier can fine tune the camber characteristics of his skis to accommodate snow conditions by simply choosing the insert orientation providing the appropriate degree of camber-flattening resistance for prevailing conditions.

In highly preferred embodiments of this invention the inserts are held within the voids by frictional engagement, and can be removed and reinserted or replaced with ease.

This invention is particularly advantageous in eliminating the need for a manufacturer and seller to present a vast array of skis and various lengths and flexibilities. By providing an array of four insert sets, for example, together with a choice of perhaps three ski lengths, highly suitable skis could be created for adult skiers of virtually every weight and level of expertise. The cost of skis may thus be reduced.

The invention also provides an extended useful life for skis. As a skier's weight and ability change over the years, the skis can be adjusted with new inserts to provide the camber characteristics needed. Thus, such a skier need not purchase new skis as frequently.

OBJECTS OF THE INVENTION

It is an object of this invention to provide a snow ski and a method for providing such ski which overcomes certain problems and disadvantages of the prior art.

Another object of this invention is to provide a snow ski with adjustable camber characteristics and a method for providing such ski.

Another object of this invention is to provide a snow ski providing adjustable camber characteristics particularly suited to individual skiers.

Still another object of this invention is to provide an adjustable camber ski which is reliable in operation and practical to construct.

Yet another object of this invention is to provide a snow ski with adjustable camber characteristics allowing a skier to adjust his skis readily to accommodate changing snow conditions.

These and other important objects of the invention will become apparent from the following descriptions and from the drawings showing preferred embodiments wherein:

DESCRIPTION OF PREFERRED EMBODIMENTS

Figure 1:
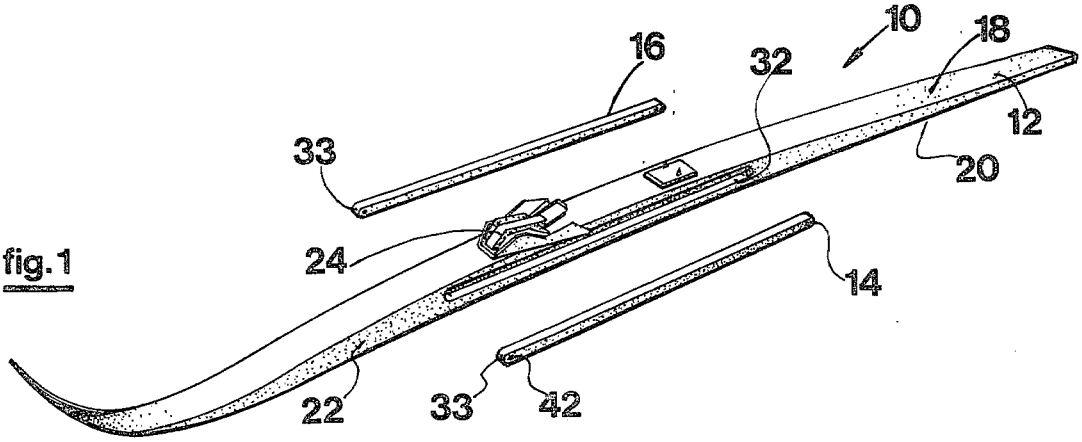
FIG. 1 is an exploded perspective view of a preferred cross country ski of this invention.

The figures show a cross country ski 10 including an elongate, substantially flat body 12 and elongate body-stiffening inserts 14 and 16. Flat body 12 includes an upper surface 18, a lower surface 20, and opposing side surfaces 22. Upper surface 18 includes a connector 24 allowing attachment of the skier's boot 25. The lower surface, of course, is in contact with the snow.

Figure 2:
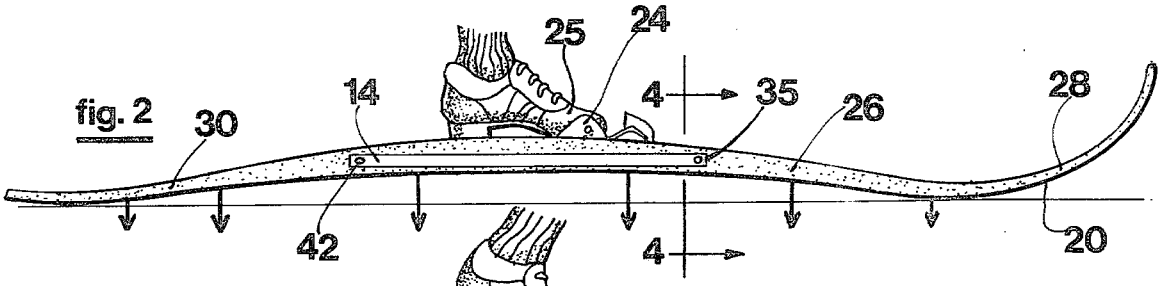
FIG. 2 is a side elevation of another embodiment, showing the ski in the glide mode.
Figure 3:
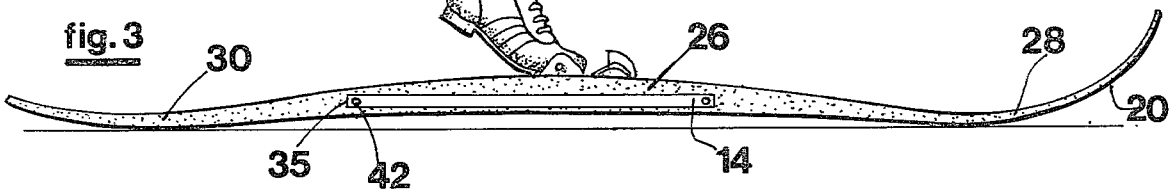
FIG. 3 is another side elevation, as in FIG. 2, but showing the ski in the kick mode.

Ski 10 includes a foot-mounting mid-portion 26 and front and rear portions 28 and 30 on opposite sides of mid-portion 26. Lower surface 20 of front and rear portions 28 and 30 is normally made as smooth and friction-free as reasonably possible. Front and rear portions 28 and 30 bear the weight of the skier on the snow during the glide mode, as illustrated in FIG. 2. Lower surface 20 of the ski at mid-portion 26 of the ski is made to provide a degree of frictional engagement with the snow during the kick mode, as illustrated in FIG. 3.

Side surfaces 22 of the skis shown in the drawings define opposing insert-receiving voids 32 extending along either side of body mid-portions 26 of the skis. Voids 32 are configured to receive inserts 14 and 16 and hold such inserts by frictional engagement. Inserts 14 and 16 are dimensioned to facilitate such frictional engagement.

The inserts shown in FIG. 1, which have semicylindrical end surfaces 33, are particularly designed for insertion into voids 32 in only one orientation. However, inserts such as those shown in FIGS. 2–5 have squared ends 35 and square cross sections at points along their lengths. Such inserts are built to have stiffness characteristics which differ depending upon the direction in which they are bent. Thus, such an insert may bend more easily in one direction (for example, the X direction illustrated for inserts 34 in FIG. 5) than another direction (for example, the Y direction shown in FIG. 5). The X and Y directions are 90° apart in rotational spacing about the longitudinal axis of the insert. Such dual flexibility may be obtained in a number of ways, as will be described hereafter. By securing such inserts in voids 32 in a selected orientation, a skier is able to adjust his skis to have a desired camber-flattening resistance.

Figure 4:
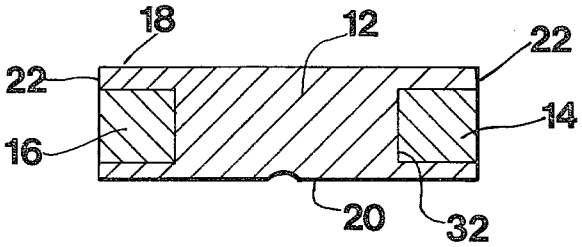
FIG. 4 is a sectional view taken along section line 4—4 as indicated in FIG. 2.

FIG. 4 is a cross-sectional view illustrating a preferred cross-sectional shape for inserts 14 and 16 and voids 32 in which they are inserted. When inserts 14 and 16 have differing stiffness characteristics in the two possible orientations, it is highly preferred that their cross-sectional shape and the cross-sectional shape of voids 32 be square at points along their lengths, as shown in FIGS. 4 and 5.

Figure 5:
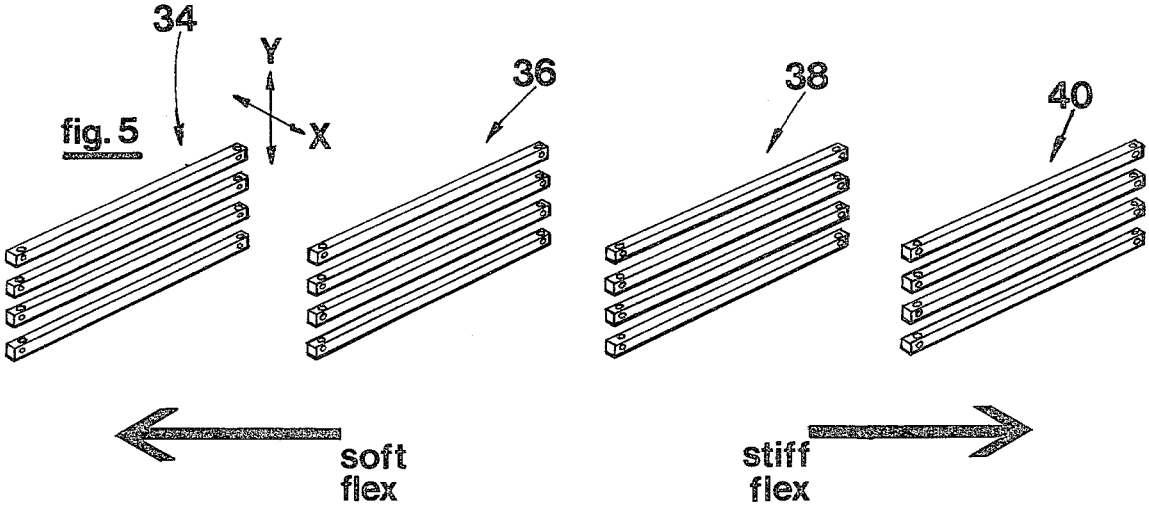
FIG. 5 is a perspective view of an array of inserts of varying flexibility.

FIG. 5 illustrates an array of inserts usable in the method of this invention. According to the method of this invention, a cambered ski having a camber-flattening resistance appropriate for a given skier and/or ski conditions can be constructed by providing one or more ski bodies 12 having opposing side surfaces 22 defining similar insert-receiving voids 32 extending along their body mid-portions 26, and providing an array of inserts having differing stiffness characteristics but all dimensioned to be removably secured in voids 32. Inserts 34 have a higher flexibility than inserts 36, 38 and 40, which are progressively less flexible, inserts 40 having relatively stiff flex characteristics. Having chosen a particular ski body 12, a skier can select a set of four inserts (two for each ski) from the array according to his weight and ability, and perhaps according to the ski conditions. After selecting a set of inserts, the inserts are secured within voids 32 on the opposing side surfaces 22 of the skis.

The inserts are preferably frictionally engaged within the insert-receiving voids. However, attachment devices of various kinds, such as screws or bolts or even tape, can be used. Means for facilitating removal, such as loops, hooks, or grasping apertures 42, shown in FIGS. 1, 2 and 3, may also be provided on the inserts.

Inserts for use in this invention may be made from a wide variety of materials and using a wide variety of well known fabrication means. A flexible fiberglass-balsa wood construction has been found to be satisfactory. Laminates of various types, and a wide variety of other constructions would be acceptable. Acceptable insert constructions would be apparent to those familiar with this invention. The flat ski bodies 12 may be made using techniques known to those skilled in the art.

While in the foregoing specification this invention has been described in relation to certain preferred embodiments thereof and many details have been set forth for purpose of illustration, it will be apparent to those skilled in the art that the invention is susceptible to additional embodiments and that certain of the details described herein can be varied considerably without departing from the basic principles of the invention.

I claim:

1. In a ski of the type having an elongate, substantially flat body with upper and lower surfaces, opposing side surfaces therebetween, and a foot-mounting mid-portion, the improvement comprising:

the body having a resiliently flattenable camber;

the opposing side surfaces defining insert-receiving voids extending along the body mid-portion; and elongate, body-stiffening inserts removably secured within the voids and providing with the body a particular camber-flattening resistance, said voids and inserts being dimensioned such that each insert is flush with its corresponding ski body side surface and is held by frictional engagement.

2. The ski of claim 1 wherein the inserts are dimensioned to allow insertion into the voids in either a first orientation providing a first camber-flattening resistance or a second orientation rotated 90° about the insert axis from the first orientation and providing a second camber-flattening resistance.

3. The ski of claim 2 wherein the inserts are of square cross-section at points along their length.

4. A method for providing a cambered ski having a camber-flattening resistance approppriate for a given skier and/or ski conditions, comprising:

providing an elongate, substantially flat, ski body with upper and lower surfaces, opposing side surfaces therebetween and a foot-mounting mid-portion, said side surfaces defining insert-receiving voids extending along the body mid-portion;

providing an array of inserts having differing stiffness characteristics, the inserts and voids being dimensioned such that the inserts are removably frictionally secured in their corresponding voids and flush with their corresponding ski side surfaces;

selecting a pair of inserts from the array; and securing such selected inserts in the insert-receiving voids.

5. The method of claim 4 wherein the inserts are dimensioned to allow insertion into the voids in either a first orientation providing a first camber-flattening resistance or a second orientation rotated 90° about the insert axis from the first orientation and providing a second camber-flattening resistance, and wherein the inserts are secured in the voids in one of the orientations.

6. The method of claim 5 wherein the inserts are of square cross-section at points along their length.

* * * * *